US008759698B2

(12) United States Patent
Chiba et al.

(10) Patent No.: US 8,759,698 B2
(45) Date of Patent: Jun. 24, 2014

(54) KEY SWITCH STRUCTURE

(75) Inventors: Toshimi Chiba, Gunma (JP); Hiromi Ebisawa, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 125 days.

(21) Appl. No.: 13/452,814

(22) Filed: Apr. 20, 2012

(65) Prior Publication Data

US 2012/0285811 A1 Nov. 15, 2012

(30) Foreign Application Priority Data

May 13, 2011 (JP) ..... 2011-108063

(51) Int. Cl.
*H01H 9/00* (2006.01)

(52) U.S. Cl.
USPC ..... 200/310; 200/314; 200/344; 362/23.05

(58) Field of Classification Search
USPC ..... 200/344, 310–314; 362/23.03, 23.04, 362/23.05
See application file for complete search history.

(56) References Cited

U.S. PATENT DOCUMENTS

| | | | | |
|---|---|---|---|---|
| 6,225,586 | B1 * | 5/2001 | Watanabe et al. | 200/344 |
| 7,847,204 | B2 * | 12/2010 | Tsai | 200/314 |
| 8,173,922 | B2 * | 5/2012 | Chen | 200/314 |
| 2009/0078552 | A1 * | 3/2009 | Takemae et al. | 200/344 |
| 2011/0168537 | A1 * | 7/2011 | Yamada | 200/344 |
| 2012/0080297 | A1 * | 4/2012 | Takeuchi et al. | 200/310 |

FOREIGN PATENT DOCUMENTS

| | | |
|---|---|---|
| CN | 2338866 | 9/1999 |
| CN | 1326205 | 12/2001 |
| CN | 101414520 | 4/2009 |
| JP | 4341733 B2 | 10/2009 |

* cited by examiner

*Primary Examiner* — Vanessa Girardi
(74) *Attorney, Agent, or Firm* — Rabin & Berdo, P.C.

(57) ABSTRACT

There is provided a key switch structure including: a plate shaped key top; a link mechanism supporting the key top such that the key top can be depressed; a membrane sheet comprising a contact point portion; a back plate supporting the link mechanism and adhered to the membrane sheet; a plurality of holder members insert molded onto the back plate and supporting the link mechanism; and a resilient member provided between the key top and the membrane sheet, the resilient member being compressed by depressing of the key top and pressing the contact point portion to make a continuity.

1 Claim, 10 Drawing Sheets

KEY SWITCH STRUCTURE

CROSS-REFERENCE TO RELATED APPLICATION

This application is based on and claims priority under 35 USC 119 from Japanese Patent Application No. 2011-108063 filed on May 13, 2011, the disclosure of which is incorporated by reference herein.

BACKGROUND

1. Technical Field

The present invention relates to a key switch structure, and in particular relates to a key switch structure employed in a keyboard where there is a strong demand for thinner models, for example in a portable personal computer or word processor.

2. Related Art

In keyboards employed in for example portable personal computers, configuration is made such that no matter where on the key top a key is depressed, the key top moves downwards without tilting, ensuring good operation characteristics. Existing key switch structures therefore have a link mechanism provided beneath the key top. Key switch structures exist with a link mechanism provided beneath the key top (see for example Japanese Patent No. 4341733).

Such key switch structures are configured with a key top 210, a first link member 220, a second link member 230, a holder 250, a membrane 260, a back plate 270, and a resilient member 240.

As illustrated in FIG. 9 and FIG. 10, the above key switch structure is a structure provided with a configuration in which the key top 210 descends whilst maintaining a horizontal state due to a link mechanism in which two link members 220, 230 are assembled together in an X-shape.

A first support projection 224 on the first link member 220 is rotatably supported by rotation support members 214 at a rear side of the key top 210, and first support projections 234 on the second link member 230 are similarly rotatably supported by rotation support members 254 on the holder 250. Thus second support projections 222, 232 provided to the other respective ends of the link members are supported so as to be capable of sliding by slide support members 256, 212 provided to the holder 250 and the key top 210, respectively.

When the key top 210 has been depressed, the resilient member 240 deforms in a squashing direction, deforming towards the membrane 260, whilst the link members assembled together in an X-shape cause the second support projections 222, 232 to slide. The key top 210 consequently descends whilst maintaining a horizontal state.

A projection 252 provided to the holder 250 passes through a hole 262 in the membrane 260 and a hole 272 in the back plate 270, and a leading end is positioned and fixed with respect to the back plate 270 using a method such as welding.

However, when fabrication accuracy for the back plate 270 and the holder 250 is poor, and/or the accuracy when welding together the two components is poor, gaps can develop between the back plate 270 and the holder 250. There is also the possibility of the second support projection 222 (slide section) of the first link member 220 moving up and down, namely in the key top depressing direction, giving rise to a wobbling sensation during depressing as the key top 210 is unable to maintain a horizontal state.

If for the sake of convenience the holder 250 is formed as a single unified component including the rotatable support sections 254 and the slide support section 256, and the resilient member 240 is disposed directly below the center of the key top 210, there will inevitably be a thinned portion present in a portion of the link member due to the first link member 220 having a profile enclosed from the periphery by the holder 250. Accordingly force is concentrated at this thinned portion when load is applied during depressing the key top 210, giving rise to a wobbling sensation.

Even in cases where the back plate 270 is provided with an up stand into which the second support projection 222 is fitted, when the fabrication accuracy is low the link member (the second support projection 222 and the first support projections 234) will give rise to a wobbling sensation due to not being disposed correctly.

In the above structure disclosed in Japanese Patent No. 4341733, depending on the fabrication accuracy there is a concern that a sensation of insufficient rigidity during operation, referred to as a wobbling sensation, will be caused by lowering of the positional accuracy of the link member, or due to force being concentrated at thinned portions present in the link member.

SUMMARY

In consideration of the above circumstances, an object of the present invention is to provide a key switch structure with excellent holder positional accuracy and a high rigidity of link members.

To achieve the object, the present invention provides a key switch structure including: a plate shaped key top; a link mechanism supporting the key top such that the key top can be depressed; a membrane sheet including a contact point portion; a back plate supporting the link mechanism and adhered to the membrane sheet; plural holder members insert molded onto the back plate and supporting the link mechanism; and a resilient member provided between the key top and the membrane sheet, the resilient member being compressed by depressing of the key top and pressing the contact point portion to make a continuity.

Due to being configured as described above, the present invention can provide a key switch structure with excellent holder positional accuracy and a high rigidity of link members.

BRIEF DESCRIPTION OF THE DRAWINGS

Exemplary embodiments of the present invention will be described in detail based on the following figures, wherein.

DETAILED DESCRIPTION

Exemplary Embodiments

Figure 1:
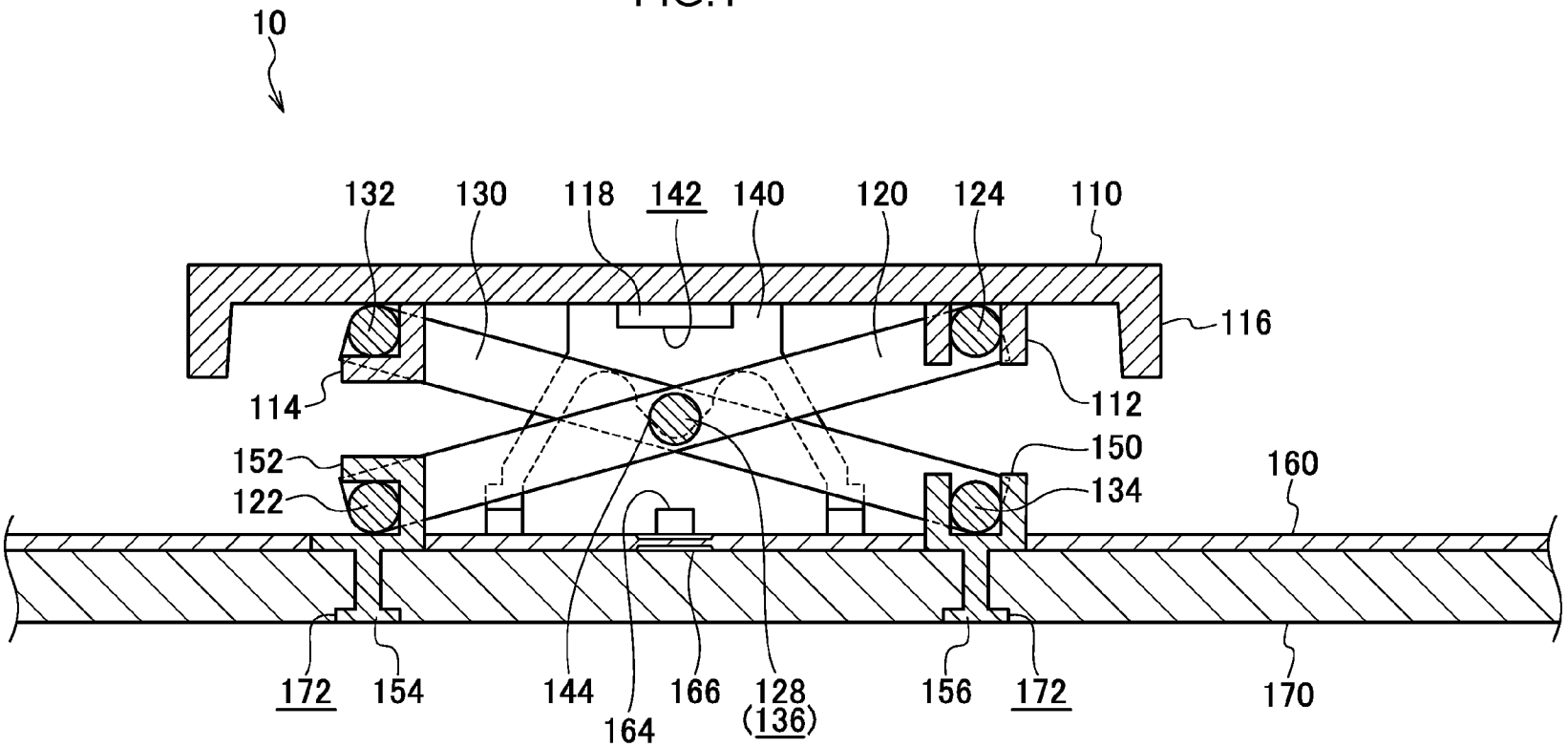
FIG. 1 is a side view illustrating a key switch structure according to a first exemplary embodiment of the present invention.
Figure 2:
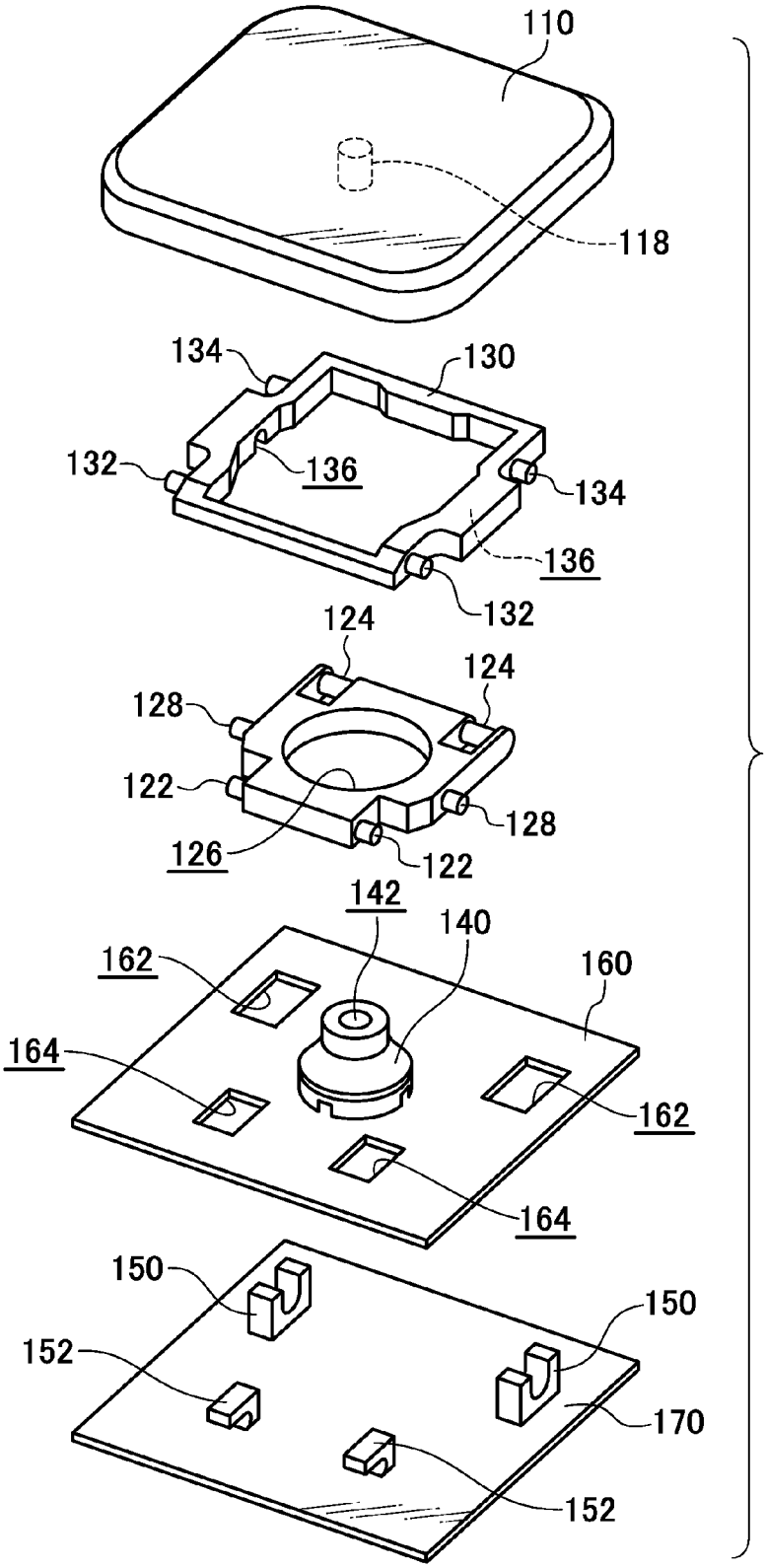
FIG. 2 is an exploded perspective illustrating the key switch structure shown in FIG. 1.
Figure 3:
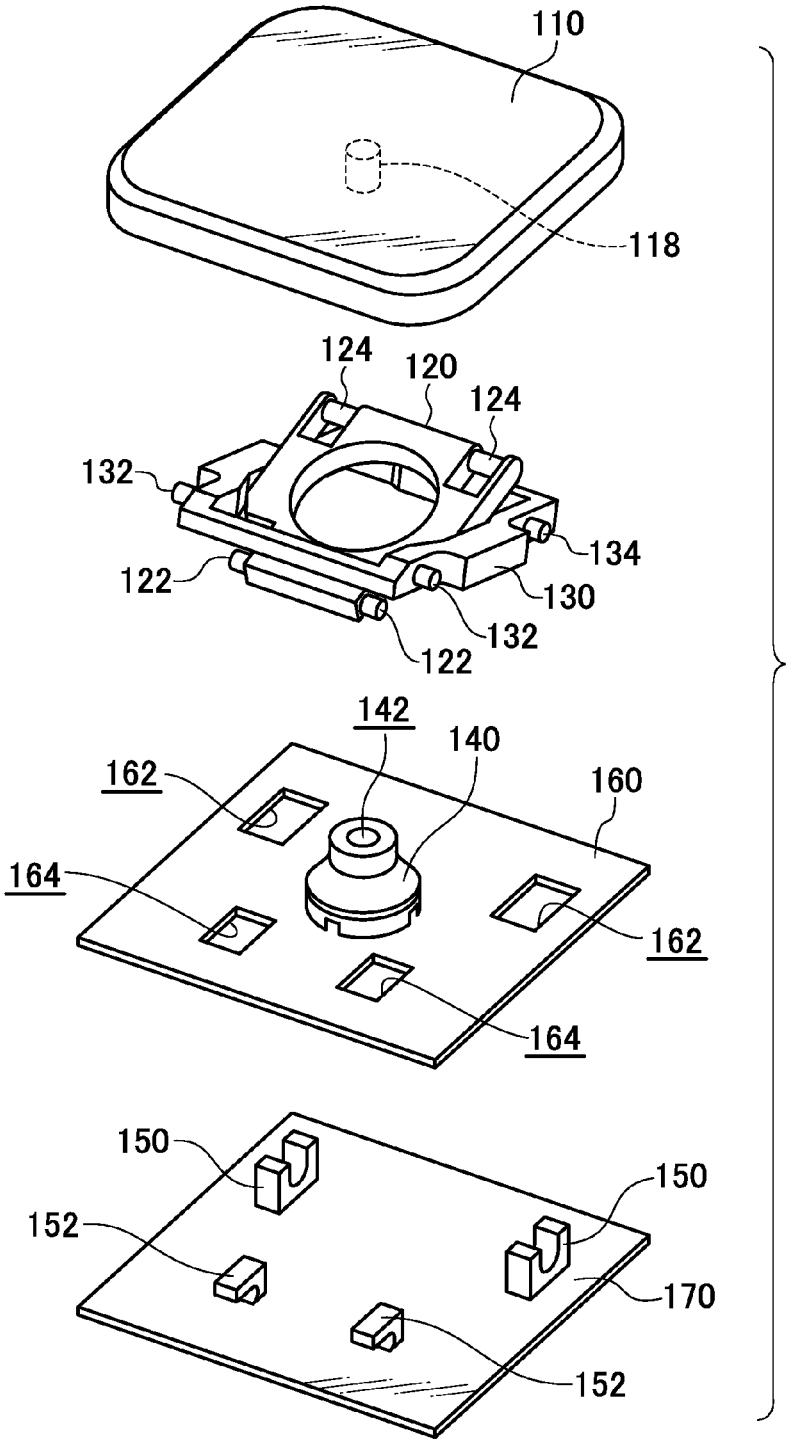
FIG. 3 is an exploded perspective view illustrating the key switch structure shown in FIG. 1.
Figure 4:
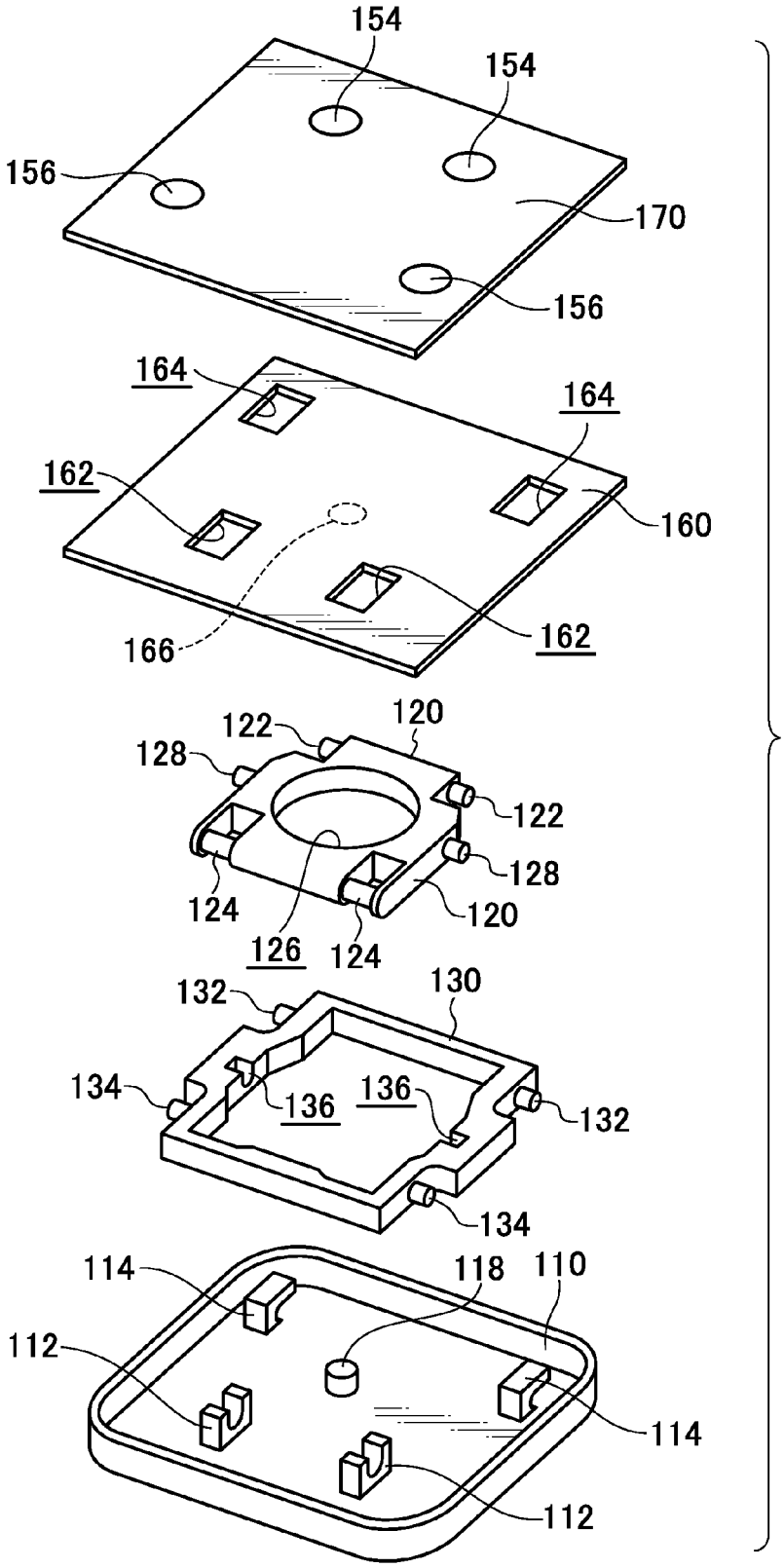
FIG. 4 is an exploded perspective view illustrating from the rear side the key switch structure shown in FIG. 1.

Explanation follows of exemplary embodiments of a key switch structure according to the present invention, with reference to the drawings. FIG. 1 is a cross-section illustrating a first exemplary embodiment, and FIG. 2 to FIG. 4 are exploded perspective views illustrating the first exemplary embodiment.

A key switch structure of the present exemplary embodiment is configured from a key top 110, a first link member 120, a second link member 130, a resilient member 140, a first holder 150, a second holder 152, a membrane sheet 160, and a back plate 170.

The back plate 170 is a plate member formed from a material having a certain degree of hardness and rigidity, such as made from a metal or a hard resin, and the membrane sheet 160 is configured from two sheets printed with wiring patterns and disposed on either side of a spacer sheet, not shown in the drawings. Namely the membrane sheet 160 is a configuration of a top sheet and bottom sheet, not shown in the drawings, that have been stuck together, and is formed from a soft material adhered to the front face of the back plate 170.

As shown in FIG. 1, holes 172 are provided in the back plate 170, and when the resin first holder 150 and second holder 152 are formed, the back plate 170 is placed in a mold with the holes already processed, and the resin first holder 150 and second holder 152 are molded to align with the positions of the holes 172. By forming the resin first holder 150 and second holder 152 in the holes 172 in the back plate 170 using what is referred to as insert molding, a structure with high positional accuracy of the first holder 150 and the second holder 152 attachment is attained.

As shown in FIG. 1, the holes 172 may be configured with a profile provided with a taper or step expanding at the rear side of the attachment face, rather than as simple straight-sided holes. In such cases, since resin is also filled into the expanded holes 172 during insert molding, flanges 156, 154 are formed to the first holder 150 and the second holder 152, respectively.

In other words, by configuring the holes 172 with profiles opened wider on the opposite side of the back plate 170 to the membrane sheet 160, such as the holes 172 shown in FIG. 1, since the first holder 150 and the second holder 152 are formed integrated to the flanges 154, 156 and passing through the holes 172, the configuration enables stronger fixing to be achieved than with a straight-sided hole profile.

Figure 9:
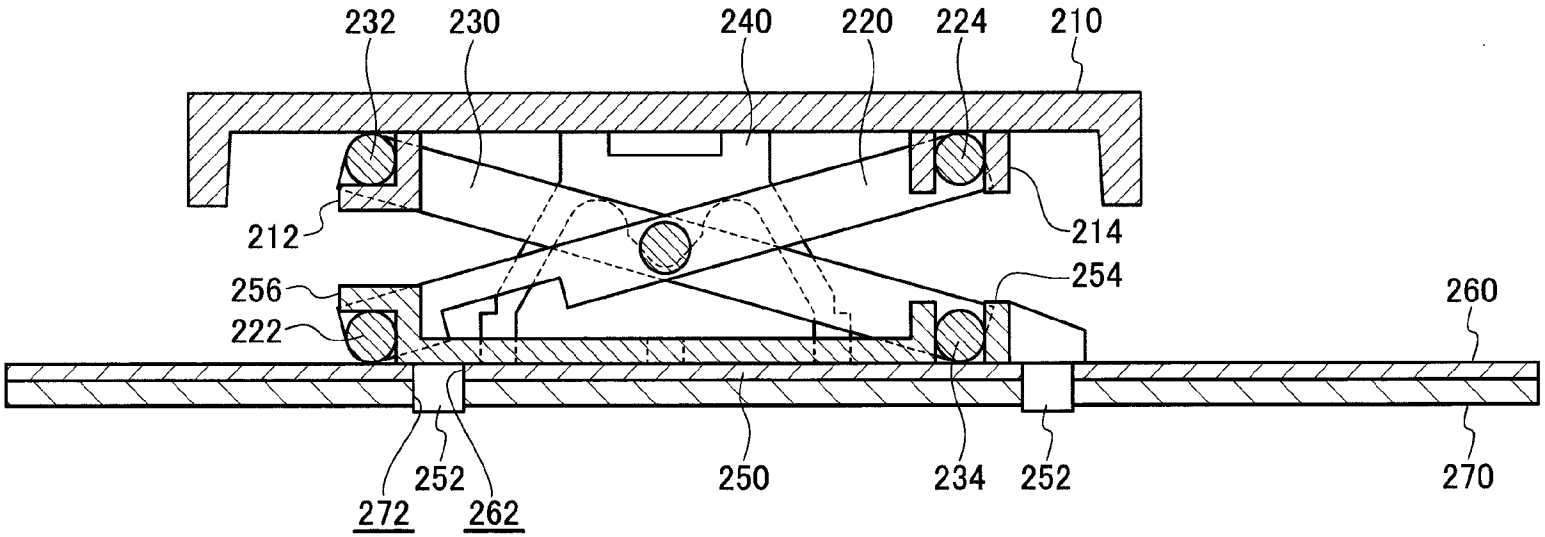
FIG. 9 Prior Art
FIG. 9 is a side view illustrating a related key switch structure.
Figure 10:
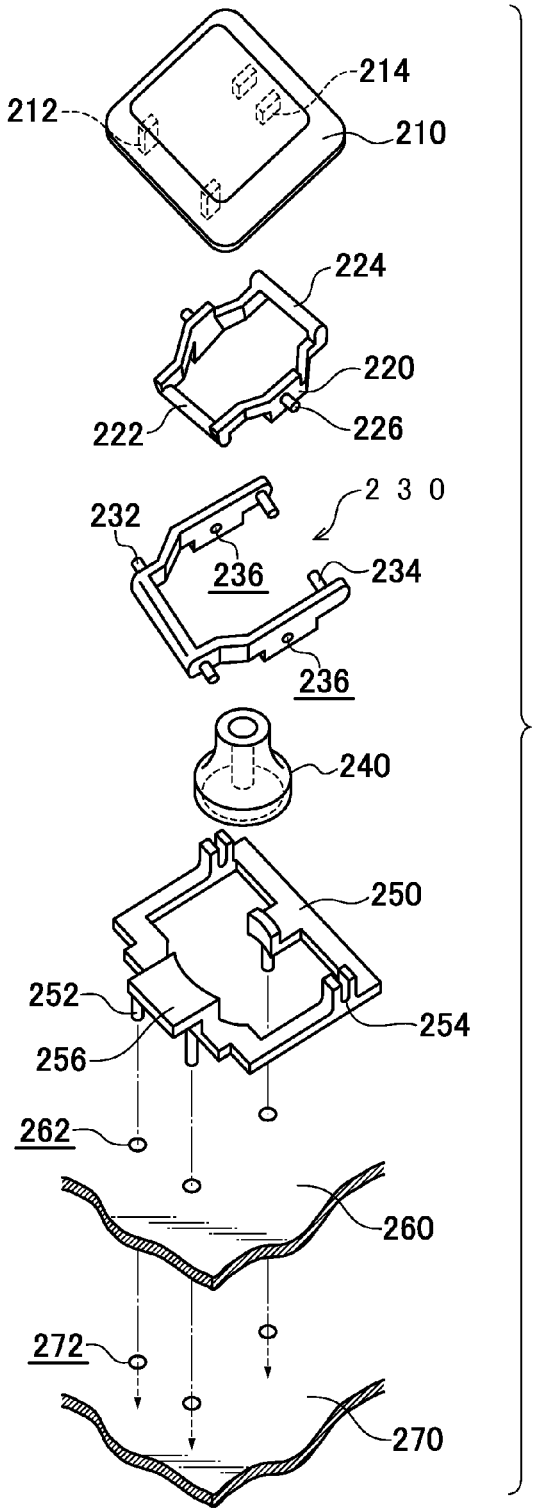
FIG. 10 Prior Art
FIG. 10 is an exploded perspective view illustrating a related key switch structure.

In a single unit holder 250 such as illustrated in the related examples in FIG. 9 and FIG. 10, it is necessary to position the link members avoiding the periphery of the single unit holder 250 so as not to impinge on the single unit holder 250, leading to a reduction in the degrees of freedom for design, and the occurrence of thinned portions in the members. However, by splitting the holder into the first holder 150 and the second holder 152, the degrees of freedom in the profile and positions of each of the link members is increased.

As shown in FIG. 1, a contact point portion 166 is provided to the interior of the membrane sheet 160. The resilient member 140 is fixed above the contact point portion 166, between the contact point portion and the key top 110, for example using an adhesive. The resilient member 140 is formed with a substantially cap-shaped profile from a material such as rubber, and has a fitting hole 142 at the center of an upper portion. A contact depressing portion 144 is formed projecting towards the membrane sheet 160 at an internal face central portion of the resilient member 140.

The key top 110 moves towards the membrane sheet 160 (back plate 170) due to the key top 110 being depressed, whilst maintaining a parallel orientation to the membrane sheet 160 (back plate 170). A projection 118 provided to the rear face of the key top 110 and fitted into the fitting hole 142 accordingly presses the upper portion of the positioned and fixed resilient member 140. The resilient member 140 accordingly undergoes compression deformation, and the internally formed contact depressing portion 144 contacts and presses the contact point portion 166 of the membrane sheet 160.

The contact point portion 166 has electrical contact points disposed at locations respectively facing each other on a top sheet and bottom sheet, not shown in the drawings, adhered to either side of a spacer sheet, not shown in the drawings, of the membrane sheet 160. When the membrane sheet 160 is pressed in the thickness direction, the two electrical contact points provided facing each other on the top sheet and bottom sheet contact each other and are electrically connected, resulting in a closed switch state as a switch.

When the depressing of the key top 110 is released, each configuration component returns to its original state due to the force of restitution (resilience) of the resilient member 140 and the membrane sheet 160, the contact point portion 166 of the membrane sheet 160 separates, and the switch enters an open state as the electrical contact is broken.

On the rear side of the key top 110 (the side facing the membrane sheet 160), rotation support members 112 are provided to rotatably support rotation shafts 124 provided to a first end of the first link member 120. Slide support members 114 are also provided to support the slide projection 132 provided to a first end of the second link member 130 such that the slide projection 132 is capable of rotation and also parallel movement (motion) in a horizontal direction (a direction along the surface of the membrane sheet 160).

The substantially rectangular frame profiled first link member 120 is provided with rotation shafts 128 that project towards the outside in the vicinity of the center of the two facing sides. Rotation shafts 124 are provided at the edge of one of the remaining two sides rotatably retained in rotation support members 112 provided to the rear side of the key top 110. Slide projections 122 are provided at the edge of the other remaining side, supported by the second holders 152 integrally provided in the holes 172 in the back plate 170, such that the slide projections 122 are capable of rotation and parallel movement (motion) in a horizontal direction.

The first link member 120 is fitted so as to overlap along the same plane as the second link member 130, forming a nested structure with the first link member 120 fitting inside the second link member 130. The rotation shafts 128 of the first link member 120 fit into shaft holes 136 provided at facing positions on the second link member, assembled as shown in FIG. 3 such that both members can rotate with the rotation shaft 128 acting as an axis.

The membrane sheet 160 is adhered onto the back plate 170 with the first holders 150 and the second holders 152 respectively clear of holes 162, 164 formed to the membrane sheet 160 at positions aligned with the first holders 150 and the second holders 152.

Components such as the link members are assembled as follows. The rotation shafts 128 of the first link member 120 fit into the shaft holes 136 of the second link member 130, such that the first link member 120 and the second link member 130 are assembled together in a rotatable X-shape. The rotation shafts 124 of the first link member 120 are inserted into the rotation support members 112 on the rear side of the key top 110 and the slide projections 132 of the second link member 130 are inserted into the slide support members 114 on the rear side of the key top 110 so as to be capable of rotation and also capable of parallel movement in a horizontal direction (a direction along the surface of the membrane sheet 160).

The first link member 120 and the second link member 130 that are assembled in an X-shape are positioned by the first holders 150 and the second holders 152 insert molded in the holes 172 provided to the back plate 170. Namely, the slide projections 122 provided to the first link member 120 are inserted into the second holders 152 and retained so as to be capable of both rotation and of parallel movement in a horizontal direction (a direction along the surface of the membrane sheet 160).

The rotation shafts 134 provided to the second link member 130 are inserted into the first holders 150 and retained so as to be capable of rotation.

Consequently, when the key top 110 is depressed, the rotatably supported rotation shafts 124, 134 only rotate at these locations, without a change in horizontal position with respect to the back plate 170. However, as the key top 110 is depressed the slide projections 122, 132 also move horizontally, above the membrane sheet 160 and at the rear side of the key top 110.

When this occurs, were the positioning accuracy of the second holders 152 to be poor, for example if the second holders 152 were to lift up from the membrane sheet 160, there would be a possibility that the movement direction of the sliding projections 122 would cause a deviation in the depressing direction of the key top 110, giving rise to a wobbling sensation.

However, in the present invention, due to the second holders 152 being insert molded and integrated to the high rigidity back plate 170, causes of poor positioning accuracy are reduced and a configuration capable of reducing any wobbling sensation is achieved. Since the first holders 150 are also insert molded to the back plate 170, a configuration with excellent positioning accuracy with respect to the second holders 152 is achieved.

As the first holders 150 and the second holders 152 are insert molded as respective independent components to the back plate 170, and as the space the first link member 120 needs to keep clear of is small, the member can be made with ample thickness. Therefore, a configuration can be achieved capable of reducing a wobbling sensation arising from concentration of force when the key top 110 is depressed.

Second Exemplary Embodiment

Figure 5A:
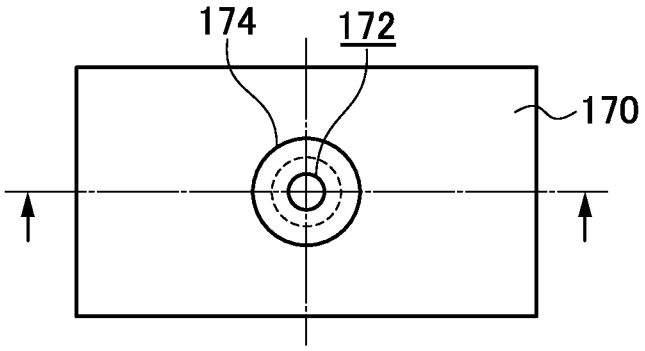
FIG. 5A and FIG. 5B are an enlarged plan view and cross-section illustrating a portion of a key switch structure according to a second exemplary embodiment of the present invention.
Figure 5B:
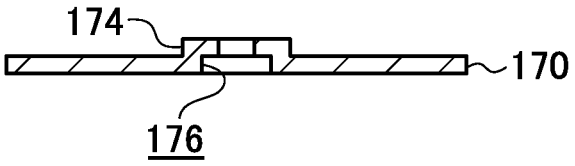

FIG. 5A is a plan view illustrating an enlarged portion of a key switch structure according to a second exemplary embodiment, and FIG. 5B is a cross-section of the location indicated.

A key switch structure of a second exemplary embodiment is configured including projection portions 174 formed by embossing centered on the holes 172 provided on the back plate 170.

Specifically, by providing the projection portions 174 centered on the holes 172 in the back plate 170 as projections towards the key top 110 side, the resin first holders 150 and second holders 152 are insert molded above the projection portion 174. The resin for molding the first holders 150 and the second holders 152 consequently also fills spaces 176 formed inside the projection portions 174.

The insert molded resin first holders 150 and second holders 152 are consequently fixed so as to be integrated through the holes 172 to the resin of flange portions formed filling the spaces 176.

Namely, in the present exemplary embodiment, in contrast to the flanges 154, 156 formed in the first exemplary embodiment illustrated in FIG. 1, the volume of the spaces 176 is not limited by the thickness of the back plate 170.

Therefore, a configuration is achieved allowing larger resin flanges to be formed than the flanges 154, 156 of the first exemplary embodiment.

In the plan view shown in FIG. 5, each of the projection portions 174 is configured as a cylindrical column, however there is no limitation thereto and projection portions 174 may be provided configured in various plan view shapes, such as a triangular column or quadrilateral column, and configuration may also be made such that plural holes 172 are provided to a single projection portion 174.

Third Exemplary Embodiment

Figure 6A:
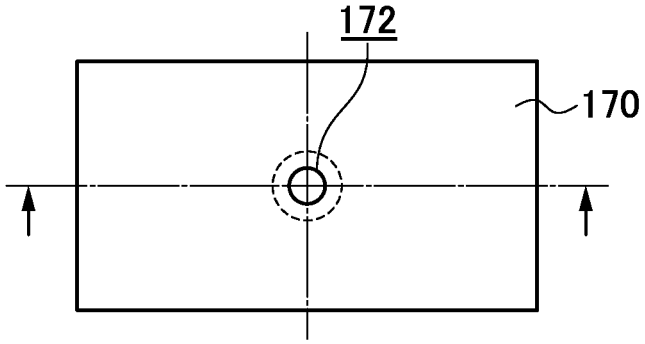
FIG. 6A and FIG. 6B are an enlarged plan view and cross-section illustrating a portion of a key switch structure according to a third exemplary embodiment of the present invention.
Figure 6B:
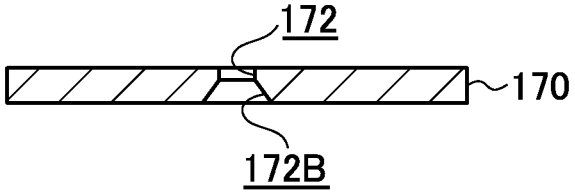

FIG. 6A is a plan view illustrating an enlarged portion of a key switch structure according to a third exemplary embodiment, and FIG. 6B is a cross-section of the indicated location.

A key switch structure of a third exemplary embodiment is configured including enlarged portions 172B formed by counter sinking centered on the holes 172 provided on the back plate 170.

Specifically, by providing the enlarged portions 172B to the back plate 170 centered on the holes 172 with a hole diameter that enlarges on the reverse face to the side on which the first holders 150 and the second holders 152 are attached, the resin first holders 150 and second holders 152 are insert molded and integrated to flanges 154, 156 formed in the enlarged portions 172B.

Namely, in the present exemplary embodiment, compared to the flanges 154, 156 formed in the first exemplary embodiment illustrated in FIG. 1, by forming the enlarged portions 172B by counter sinking a configuration is achieved allowing larger resin flanges 154, 156 to be formed. The thickness of the back plate 170 may be set thicker in order to accommodate the size of the enlarged portions 172B.

Fourth Exemplary Embodiment

Figure 7A:
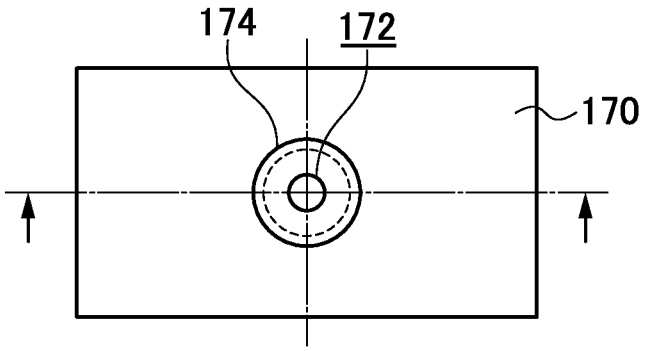
FIG. 7A and FIG. 7B are an enlarged plan view and cross-section illustrating a portion of a key switch structure according to a fourth exemplary embodiment of the present invention.
Figure 7B:
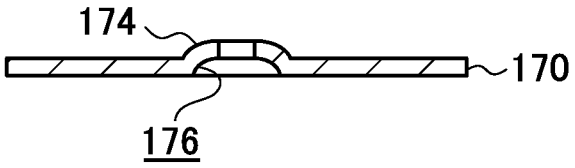

FIG. 7A is a plan view illustrating an enlarged portion of a key switch structure according to a fourth exemplary embodiment, and FIG. 7B is a cross-section of the indicated location.

A key switch structure of a fourth exemplary embodiment is configured with a projection portion 174 formed by drawing centered on the holes 172 provided to the back plate 170.

Specifically, by providing the projection portions 174 centered on the holes 172 to the back plate 170 as projections towards the key top 110 side, the resin first holders 150 and second holders 152 are insert molded above the projection portions 174. The resin for molding the first holders 150 and the second holders 152 consequently also fills the spaces 176 formed inside the projection portions 174.

The first holders 150 and the second holders 152, which are insert molded resin, are consequently fixed and integrated through the holes 172 to the resin of the flange portions formed filling the spaces 176.

Namely, in the present exemplary embodiment, in contrast to the flanges 154, 156 formed in the first exemplary embodiment illustrated in FIG. 1, the volume of the spaces 176 is not limited by the thickness of the back plate 170, achieving a configuration allowing larger resin flanges to be formed than the flanges 154, 156 of the first exemplary embodiment.

As the projection portions 174 are shaped by drawing, a configuration is achieved in which concentration of stress in the flanges is not liable to occur, as the locations of corners and sharp angles in the spaces 176 can be reduced compared with forming by embossing or machining.

In the plan view of FIG. 7A, the projection portion 174 has a semi-spherical shape, however there is no limitation thereto and the projection portions 174 may be configured with various profiles such as a trapezoid shape, or a pyramid shape. Configuration may also be made such that a single projection portion 174 is provided with plural holes 172.

Fifth Exemplary Embodiment

Figure 8:
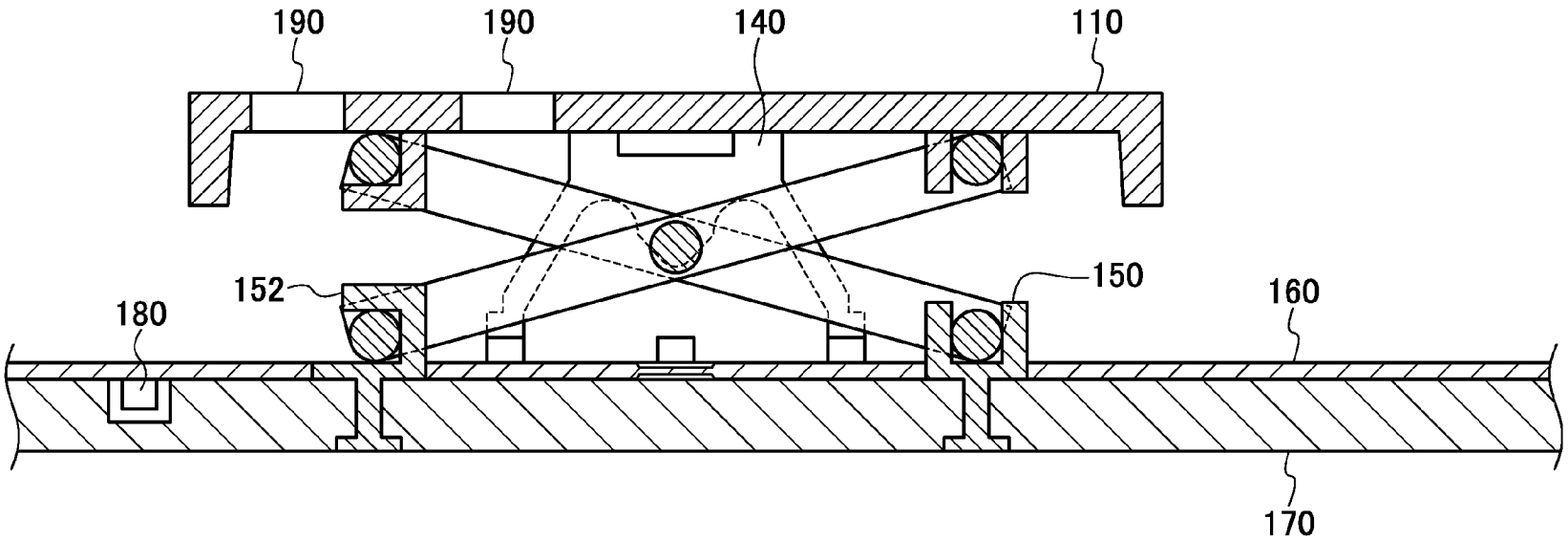
FIG. 8 is a cross-section illustrating a key switch structure according to a fifth exemplary embodiment of the present invention.

FIG. 8 is a cross-section illustrating a portion of a key switch structure according to a fifth exemplary embodiment.

A key switch structure of a fifth exemplary embodiment is configured by insert molding first holders 150 and second holders 152 from opaque resin onto a back plate 170 formed from a light transmitting material such as a transparent resin.

A light source 180 such as an LED is embedded in the back plate 170, and electrically connected to the membrane sheet 160 so as to emit light when supplied with electricity. The light source 180 illuminates the key top 110 from the back plate 170 side with the transparent back plate 170 serving as a light guiding member. More preferably the membrane sheet 160 and the resilient member 140 are also formed as light guiding members formed from transparent materials.

As shown in FIG. 8, the key top 110 is provided with transparent illumination windows 190 in a structure transmitting even more light from the light source 180 through the back plate 170 to illuminate the key top 110. The light from the light source 180 accordingly passes through illumination windows 190 and can be seen from above the key top 110.

The first holders 150 and the second holders 152 here are insert molded to the transparent back plate 170 using opaque resin. A configuration is thereby achieved capable of preventing a reduction in light intensity due to the light emitted from the light source 180 being scattered by the first holders 150 and the second holders 152.

Sixth Exemplary Embodiment

A key switch structure of a sixth exemplary embodiment is configured with plural projection portions as projections formed in an array projecting to the key top 110 side on the transparent back plate 170 of the fifth exemplary embodiment.

By arraying projection portions on the transparent back plate 170 the projection portions reflect light guided from the light source 180 so as to appear as light emitting dots from the key top 110 side.

That is to say, by reflecting light from the light source 180 the array of projection portions on the transparent back plate 170 illuminate the key top 110 from the inside. A configuration is consequently achieved enabling an increased light intensity to be transmitted through the illumination windows 190.

Note that the projection portions provided to the back plate 170 may be pre-formed on the transparent resin sheet forming the back plate 170, may be provided at the same time as the first holders 150 and the second holders 152 during insert molding, or may be provided anew after insert molding.

CONCLUSION

Examples of exemplary embodiments of the present invention have been described above, however the present invention is not limited by any of the above exemplary embodiments, and obviously various embodiments can be implemented within a range not departing from the spirit of the invention. For example, the present invention relates to a key switch structure, however the present invention is also applicable to other structures of movable components employing link members.

Namely the present invention is applicable where link members are retained above a plate shaped member, and is applicable to various structures as fixing structures for fixing link members to a plate shaped member.

What is claimed is:

1. A key switch structure, comprising:

a plate shaped key top;

a link mechanism supporting the key top such that the key top can be depressed;

a membrane sheet comprising a contact point portion;

a back plate supporting the link mechanism and adhered to the membrane sheet;

a plurality of holder members insert molded onto the hack plate and supporting the link mechanism;

a resilient member provided between the key top and the membrane sheet, the resilient member being compressed by depressing of the key top and pressing the contact point portion to make a continuity; and a light source that illuminates the back plate that is formed from a transparent resin plate, wherein a first holder member and second holder member are formed from opaque resin insert molded onto the back plate.

* * * * *